US008019250B2

(12) United States Patent
Yamazaki

(10) Patent No.: US 8,019,250 B2
(45) Date of Patent: Sep. 13, 2011

(54) DEVELOPER CARTRIDGE HAVING INNER AND OUTER CASINGS

(75) Inventor: Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/728,607

(22) Filed: Mar. 22, 2010

(65) Prior Publication Data

US 2010/0272465 A1 Oct. 28, 2010

(30) Foreign Application Priority Data

Apr. 28, 2009 (JP) ..... 2009-109703

(51) Int. Cl.
*G03G 15/08* (2006.01)

(52) U.S. Cl. ..... 399/106; 399/262

(58) Field of Classification Search ..... 399/103, 399/106, 107, 111, 119, 120, 222, 258, 262, 399/263

See application file for complete search history.

(56) References Cited

U.S. PATENT DOCUMENTS

| | | | | |
|---|---|---|---|---|
| 6,151,472 | A * | 11/2000 | Nakajima | 399/262 |
| 6,324,371 | B1 * | 11/2001 | Okiyama et al. | 399/262 |
| 7,162,190 | B2 * | 1/2007 | Deguchi | 399/258 |
| 2003/0202817 | A1 * | 10/2003 | Higeta et al. | 399/109 |
| 2003/0219276 | A1 * | 11/2003 | Sato et al. | 399/103 |
| 2008/0193169 | A1 | 8/2008 | Teramura | |
| 2008/0205926 | A1 | 8/2008 | Mase | |
| 2009/0087216 | A1 * | 4/2009 | Sakuma | 399/106 |

FOREIGN PATENT DOCUMENTS

| | | |
|---|---|---|
| JP | 2005-274862 A | 10/2005 |
| JP | 2005-292547 A | 10/2005 |
| JP | 2008-197299 | 8/2008 |
| JP | 2008-209759 | 9/2008 |

OTHER PUBLICATIONS

JP Office Action dtd Jan. 25, 2011, JP Appln. 2009-109703, English Translation.

* cited by examiner

*Primary Examiner* — David P Porta
*Assistant Examiner* — Marcus H Taningco
(74) *Attorney, Agent, or Firm* — Banner & Witcoff, Ltd.

(57) ABSTRACT

A developer cartridge includes an inner casing, an outer casing, a sealing member, an inner protrusion and an outer protrusion. The inner casing is configured to accommodate toner therein, the inner casing having a circular cylindrical shape whose axis extends in an axial direction, the inner casing being formed with an inner opening, the inner casing having an outer peripheral surface defining a circumferential direction. The outer casing is configured to accommodate the inner casing therein, the outer casing having a circular cylindrical shape and being formed with an outer opening, the outer casing and the inner casing being capable of rotating relative to each other between a first position where the inner opening and the outer opening are in communication with each other and a second position where the outer casing covers the inner opening. The sealing member is elastically deformable and is provided on the outer peripheral surface of the inner casing and surrounds the inner opening. The inner protrusion protrudes from the outer peripheral surface of the inner casing toward the outer casing. The outer protrusion protrudes from the outer casing toward the inner casing, and serves to maintain a prescribed gap between the inner casing and the outer casing, the outer protrusion being in separation from the inner protrusion in the circumferential direction at the first position, and the outer protrusion being in riding contact with the inner protrusion at the second position to displace the outer casing toward the inner opening and to elastically squash the sealing member between the inner casing and the outer casing in the second position.

12 Claims, 9 Drawing Sheets

DEVELOPER CARTRIDGE HAVING INNER AND OUTER CASINGS

CROSS REFERENCE TO RELATED APPLICATION

This application claims priority from Japanese Patent Application No. 2009-109703 filed Apr. 28, 2009. The entire content of the priority application is incorporated herein by reference.

TECHNICAL FIELD

The present invention relates to a developer cartridge that accommodates developer (developing agent) therein.

BACKGROUND

Conventionally, a developer cartridge is detachably mounted on a developing device that is used in an image forming device. The developer cartridge accommodates developer therein and supplies the developer to the developing device when mounted thereon. One of such conventional developer cartridges includes an inner casing and an outer casing, both of which have a hollow cylindrical shape. The inner casing is formed with an inner opening and the outer casing is formed with an outer opening. The outer casing accommodates the inner casing such that relative rotation can be attained between the inner casing and the outer casing.

In this developer cartridge, the developer is supplied to the developing device through the inner opening and the outer opening which are in coincidence with and in communication with each other as a result of relative rotation between the inner casing and the outer casing. Also, a sealing member is provided between the inner and outer casings and at a position around the inner opening so that the developer cannot leak from a gap between the outer casing and the inner casing.

SUMMARY

In the above-described developing cartridge, the outer circumferential surface of the inner casing is almost entirely in contact with the inner circumferential surface of the outer casing. Hence, when the relative rotation is provided between the casings, relatively great sliding contact resistance is generated between the inner casing and the outer casing, making the relative rotation difficult.

In order to reduce the sliding contact resistance at the time of the relative rotation, a sufficient gap may be provided between the inner casing and the outer casing. However, such a configuration may possibly lead to a leakage of the developer from the gap between the inner and outer casings, since the inner casing moves within the outer casing due to vibrations and/or impacts that occur while the developer cartridge is being carried.

In view of the foregoing, it is an object of the present invention to provide a developer cartridge capable of suppressing developer from leaking between an inner casing and an outer casing, yet facilitating rotation of one casing relative to the other.

In order to attain the above and other objects, there is provided a developer cartridge including an inner casing, an outer casing, a sealing member, an inner protrusion, and an outer protrusion. The inner casing is configured to accommodate toner therein, the inner casing having a circular cylindrical shape whose axis extends in an axial direction, the inner casing being formed with an inner opening, the inner casing having an outer peripheral surface defining a circumferential direction. The outer casing is configured to accommodate the inner casing therein, the outer casing having a circular cylindrical shape and being formed with an outer opening, the outer casing and the inner casing being capable of rotating relative to each other between a first position where the inner opening and the outer opening are in communication with each other and a second position where the outer casing covers the inner opening. The sealing member is provided on the outer peripheral surface of the inner casing and surrounding the inner opening, the sealing member being elastically deformable. The inner protrusion protrudes from the outer peripheral surface of the inner casing toward the outer casing. The outer protrusion protrudes from the outer casing toward the inner casing, and serving to maintain a prescribed gap between the inner casing and the outer casing, the outer protrusion being in separation from the inner protrusion in the circumferential direction at the first position, and the outer protrusion being in riding contact with the inner protrusion at the second position to displace the outer casing toward the inner opening and to elastically squash the sealing member between the inner casing and the outer casing in the second position.

DETAILED DESCRIPTION

First, a general configuration of a laser printer 1 according to a first embodiment of the present invention will be described first with reference to FIG. 1. In the following description, orientations of the laser printer 1 will be referred to assuming that the laser printer 1 is disposed in an orientation in which it is intended to be used. More specifically, the right side of the laser printer 1 in FIG. 1 will be referred to as the "front side," the left side of the laser printer 1 in FIG. 1 will be referred to as the "rear side," the near side of the laser printer 1 in FIG. 1 will be referred to as the "left side," and the far side of the laser printer 1 in FIG. 1 will be referred to as the "right side." Further, the top-to-bottom direction in FIG. 1 will be referred to as the "vertical direction".

Figure 1:
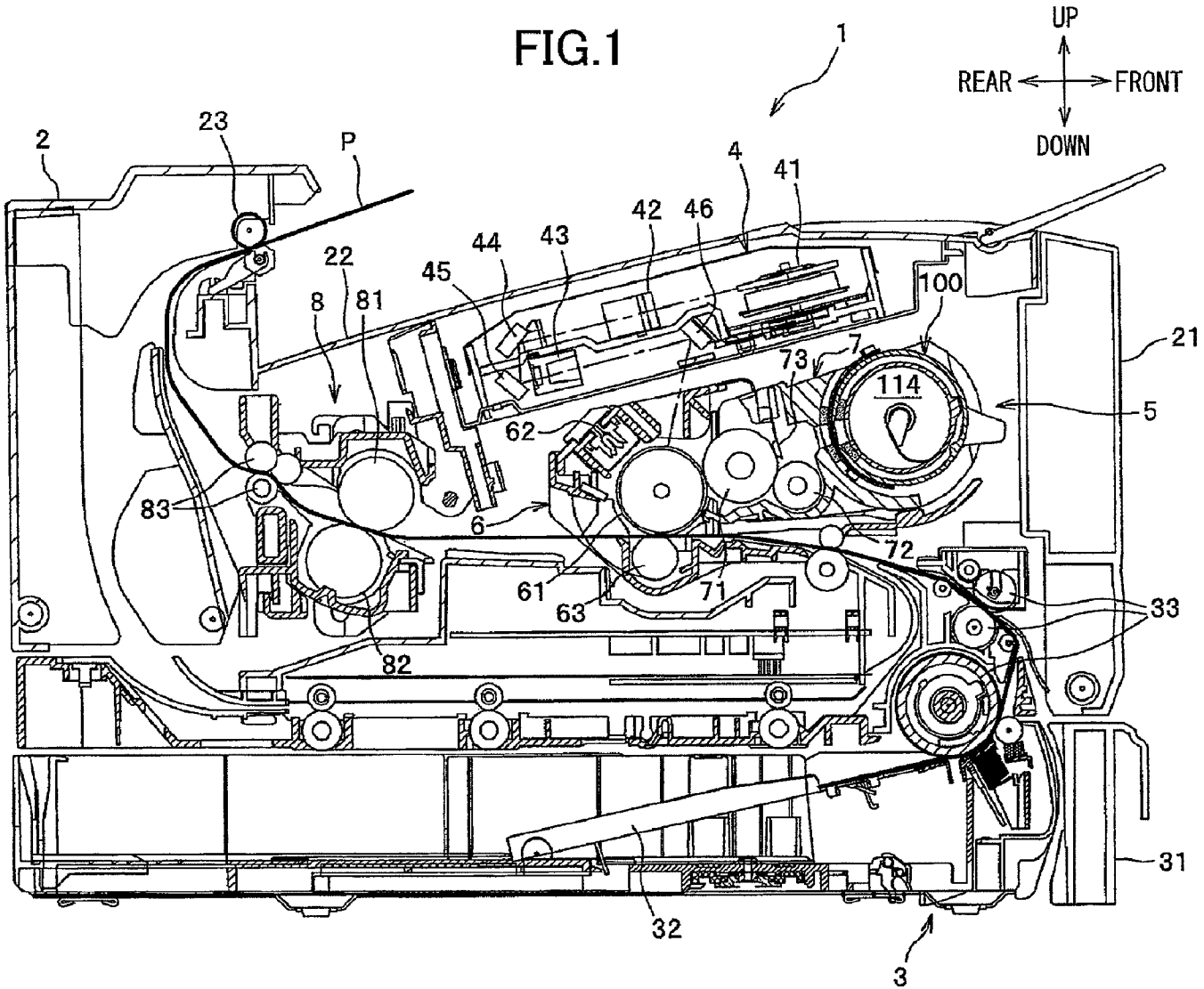
FIG. 1 is s cross-sectional view of a printer according to a first embodiment of the present invention, in which a process cartridge including a toner box according to the first embodiment is mounted in the printer.

The laser printer 1 has a main casing 2 within which a feeder unit 3, an exposure unit 4, a process cartridge 5 and a fixing unit 8 are disposed, as shown in FIG. 1. The main casing 2 is provided with a front cover 21 at a front side thereof. The main casing 2 has an upper surface on which a discharge tray 22 is formed.

The feeder unit 3 is disposed at a position lowermost within the main casing 2. The feeder unit 3 includes a sheet tray 31, a lifter plate 32 and a plurality of rollers 33. The sheet tray 31 accommodates sheets P in a stacked state. The lifter plate 32 lifts the sheets P accommodated in the sheet tray 31 upward to allow the sheets P to reach the rollers 33. The plurality of rollers 33 separate the sheets P one by one, remove paper dusts from each sheet P, and convey each sheet P to the process cartridge 5.

The exposure unit 4 is disposed at a position uppermost within the main casing 2. The exposure unit 4 includes a laser source (not shown), a polygon mirror 41, lenses 42 and 43, and reflection mirrors 44, 45 and 46. A laser beam emitted from the laser source based on image data is reflected by or passes through the polygon mirror 41, the lexis 42, the reflection mirrors 44 and 45, the lens 43 and the reflection mirror 46 in this order, and is finally irradiated onto a photosensitive drum 61 (to be described later) at a high speed, as indicated by a chain line in FIG. 1.

The process cartridge 5 is disposed below the exposure unit 4. The process cartridge 5 is detachably mountable in the main casing 2 when the front cover 21 is opened. The process cartridge 5 includes a photosensitive cartridge 6, a developing cartridge 7 and a toner box 100.

The photosensitive cartridge 6 includes the photosensitive drum 61, a charger 62 and a transfer roller 63. The developing cartridge 7 is detachably mountable on the photosensitive cartridge 6, and includes a developing roller 71, a supply roller 72 and a thickness regulation blade 73.

The toner box 100 is detachably mountable on the developing cartridge 7. This means that the toner box 100 partly constitutes the process cartridge 5 and the toner box 100 is detachably mountable in the main casing 2 as a part of the process cartridge 5. The toner box 100 defines therein a toner accommodation chamber 114. A detailed configuration of the toner box 100 will be described later.

The photosensitive dram 61 has a surface that is uniformly charged by the charger 62. After being charged, the surface of the photosensitive drum 61 is exposed to light by the laser beam emitted from the exposure unit 4, thereby forming an electrostatic latent image on the surface of the photosensitive drum 61 based on the image data. In the meantime, the toner within the toner accommodation chamber 114 is supplied to the developing roller 71 via the supply roller 72, enters between the developing roller 71 and the thickness regulation blade 73, and is carried on the developing roller 71 as a thin layer of uniform thickness.

The toner borne on the developing roller 71 is then supplied to the electrostatic latent image formed on the surface of the photosensitive drum 61 as the developing roller 71 rotates. In this way, the electrostatic latent image is made into a visible toner image on the surface of the photosensitive drum 61. When the sheet P passes between the photosensitive drum 61 and the transfer roller 63, the toner image on the surface of the photosensitive drum 61 is transferred to the sheet P.

The fixing unit 8 is disposed rearward of the process cartridge 5. The fixing unit 8 includes a heat roller 81, a pressure roller 82, and conveyor rollers 83. The heat roller 81 applies heat to the sheet P, while the pressure roller 82 nips the sheet P together with the heat roller 81 when the sheet P passes between the heat roller 81 and the pressure roller 82. In this way, the toner image transferred on the sheet P is thermally fixed while the sheet P passes between the heat roller 81 and the pressure roller 82. The sheet P is finally discharged out of the main casing 2 onto the discharge tray 22 by the conveyor rollers 83 and a pair of discharge rollers 23 provided on the main casing 2.

Next, a detailed configuration of the toner box 100 will be described with reference to FIGS. 2A through 5B.

Figure 2A:
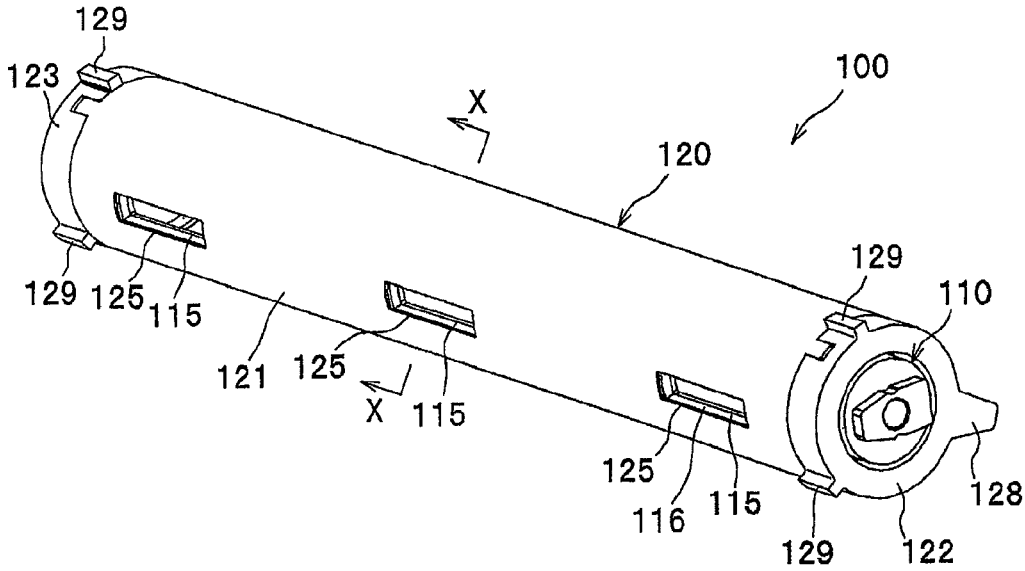
FIG. 2A is a perspective view of the toner box according to the first embodiment, the toner box including an inner casing and an outer casing those providing an open state.
Figure 2B:
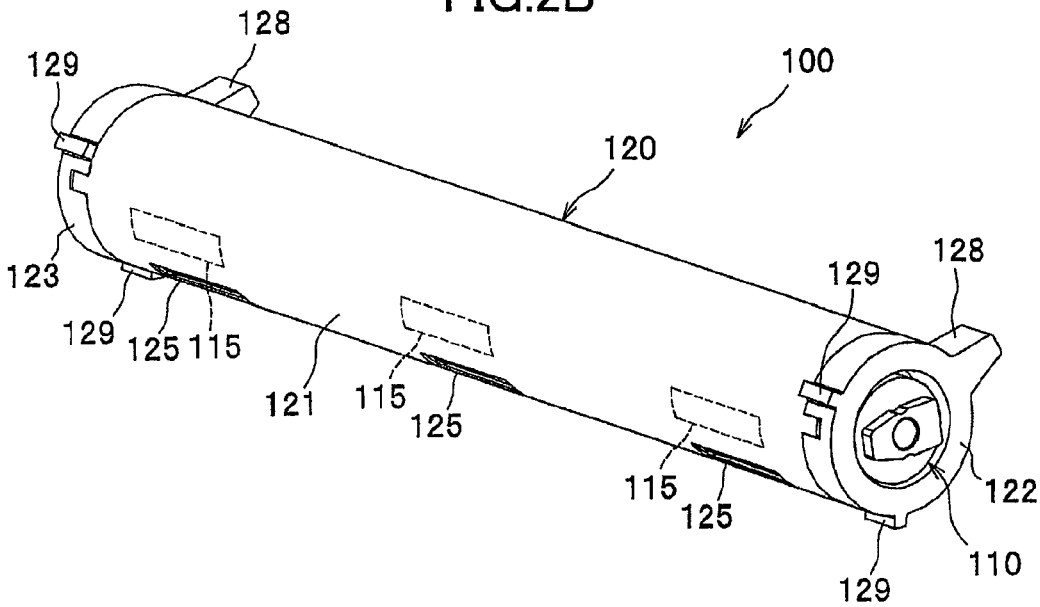
FIG. 2B is a perspective view of the toner box according to the first embodiment, in which the toner box is in a closed state.
Figure 4:
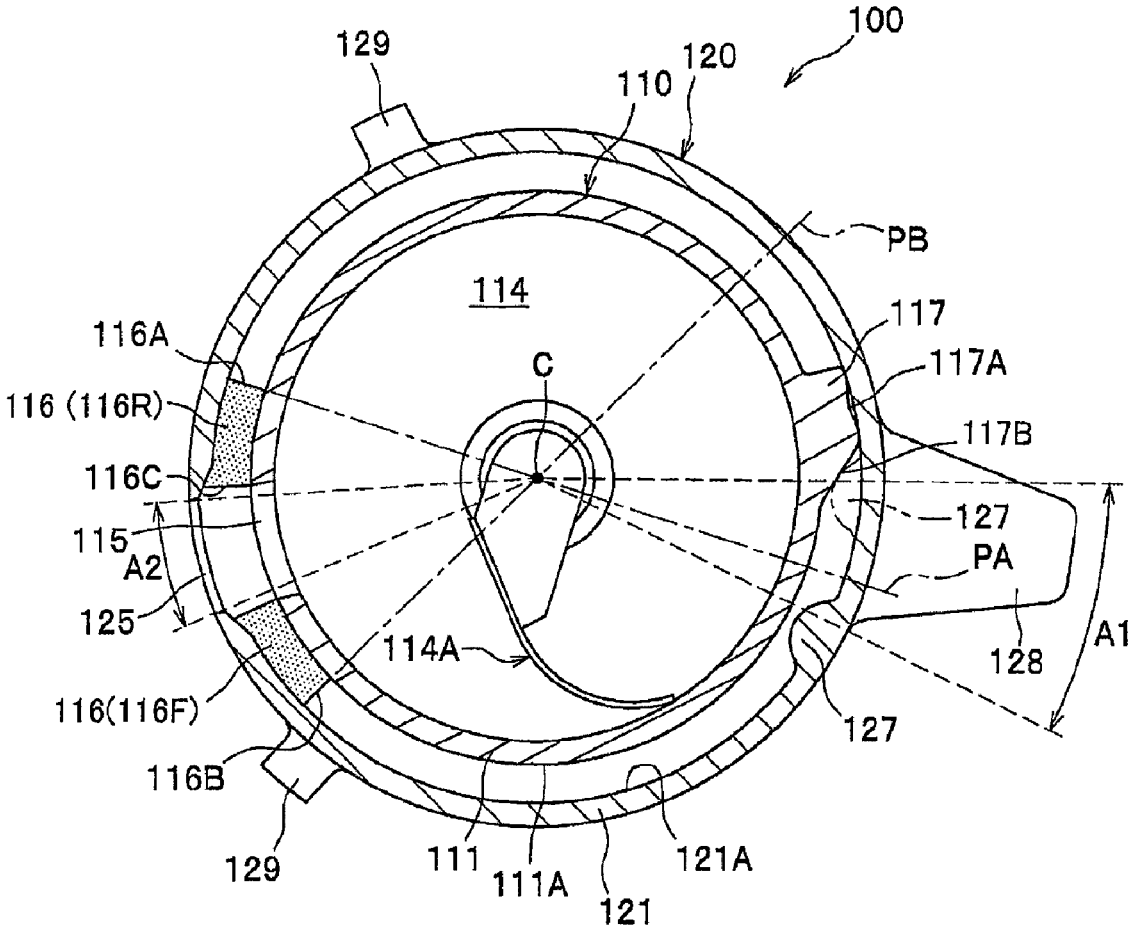
FIG. 4 is a cross-sectional view of the toner box according to the first embodiment taken along a line X-X shown in FIG. 2A.

As shown in FIGS. 2A and 2B, the toner box 100 includes an inner casing 110 and an outer casing 120. The outer casing 120 accommodates the inner casing 110 therein such that relative rotation can occur between the inner casing 110 and the outer casing 120. The toner box 100 includes the toner accommodation chamber 114 that accommodates toner therein, as shown in FIGS. 1 and 4.

More specifically, the inner casing 110 has a circular cylindrical shape, and includes a circumferential wall section 111 and two side walls 112 and 113. The circumferential wall section 111 has widthwise ends in a longitudinal direction thereof (i.e. the left-to-right direction) which are covered with the side walls 112 and 113. In other words, the circumferential wall section 111 and the side walls 112 and 113 define the toner accommodation chamber 114, as shown in FIG. 4.

The circumferential wail section 111 is formed with three inner openings 115 that are aligned in the longitudinal direction of the inner casing 110. Each inner opening 115 has a rectangular shape in a plan view. The three inner openings 115 are arranged on the circumferential wall section 111 such that, one is located at a center with respect to the longitudinal direction of the circumferential wall section 111, and the remaining two inner openings 115 are symmetrically positioned about the center-positioned inner opening 115 in the longitudinal direction.

Figure 3A:
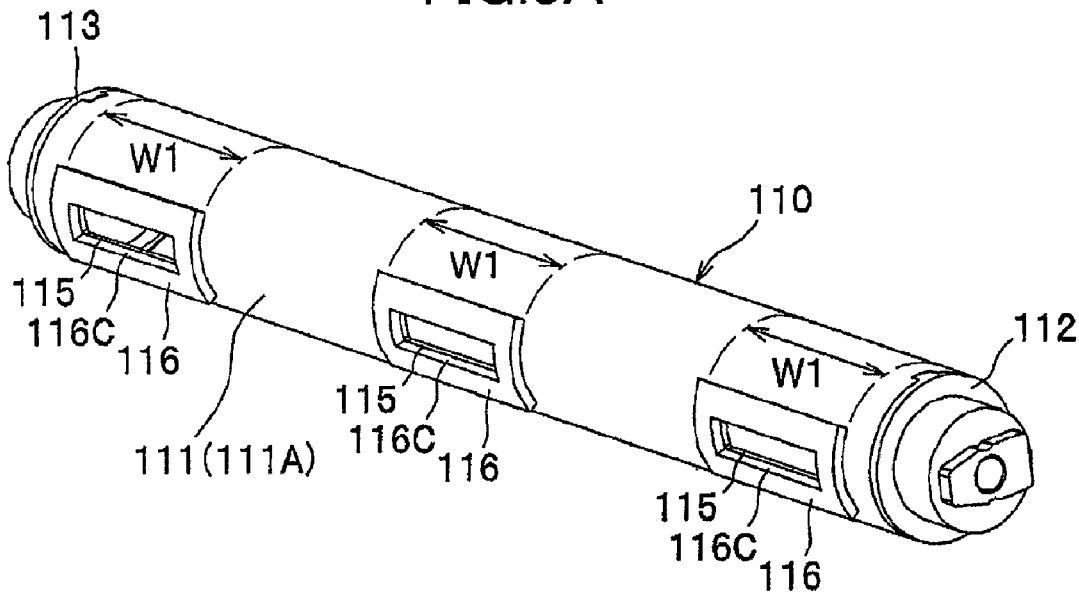
FIG. 3A is a perspective view of the inner casing according to the first embodiment, as viewed from a direction to observe inner openings.
Figure 3B:
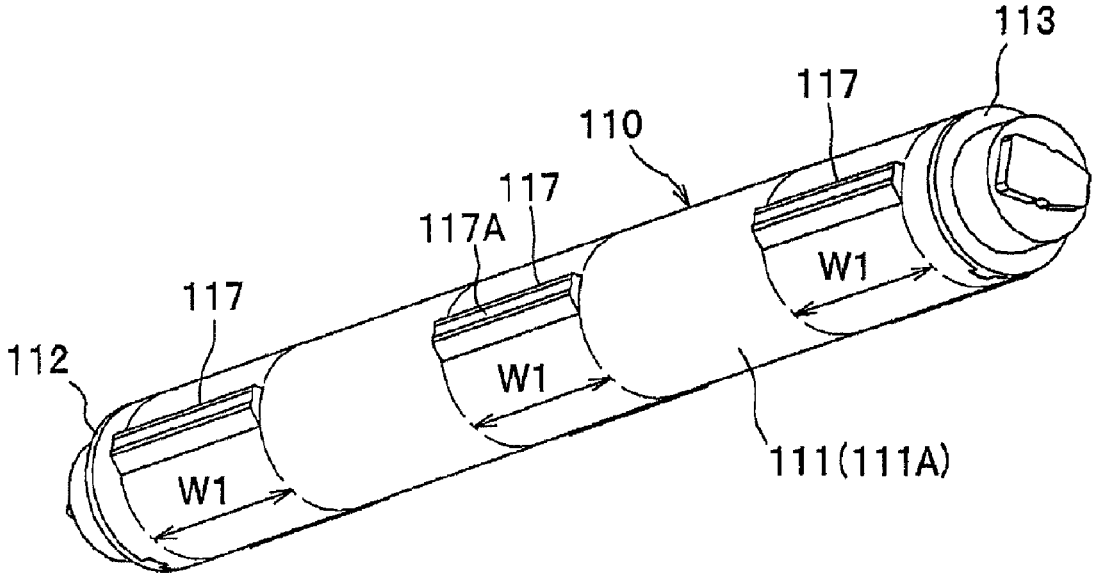
FIG. 3B is a perspective view of the inner casing according to the first embodiment as viewed from a different direction to observe inner protrusions.

The circumferential wall section 111 has an outer circumferential surface 111A on which three sealing members 116 and three inner protrusions 117 are provided, as shown in FIGS. 3A and 3B. The sealing member 116 is formed of an elastic material, such as urethane foam, and has a substantially rectangular frame shape with which an opening 116C is formed. Each sealing member 116 surrounds each of the inner openings 115. The sealing member 116 contacts an inner circumferential surface 121A of the outer casing 120 (to be described later), serving to prevent the toner from leaking between the inner casing 110 and the outer casing 120.

The inner protrusion 117 radially outwardly protrudes from the outer circumferential surface 111A of the circumferential wall section 111 (i.e., in a direction toward the outer casing 120). The inner protrusion 117 is formed in a substantially trapezoidal shape in a side view and has a top surface on which a recess 117A is formed. The recess 117A formed on the top surface has a substantially arucate shape when viewed in the radial direction. As shown in FIG. 4, the inner protrusion 117 has such a height in the radial direction so that the top surface slidably contacts the inner circumferential surface 121A of the outer casing 120 when the inner casing 110 and the outer casing 120 are relatively rotated to each other. The inner protrusion 117 is also formed with a sloped surface 117B that slopes diagonally outward from the outer circumferential surface 111A to the top surface with respect to the radial direction.

As shown in FIG. 4, the inner casing 110 has an axis C extending in the longitudinal direction. The inner protrusion 117 is disposed at a diametrically opposite side to the sealing member 116 with respect to the axis C. More specifically, the sealing member 116 has a first end 116A and a second end 116B in a circumferential direction of the inner casing 110. Here, a plane PA is defined as a plane passing the first end 116A and the axis C, while a plane PB is defined as a plane passing the second end 116B and the axis C. The inner protrusion 117 is disposed at a position opposite to the sealing member 116 with respect to the axis C and in a region between the planes PA and PB on the outer circumferential surface 111A. Hereinafter, the longitudinal direction of the inner casing 110 will also be referred to as the "axial direction."

Corresponding to the inner openings 115, the three inner protrusions 117 are arranged such that, one is positioned at a center of the outer circumferential surface 111A with respect to the axial direction and the other two protrusions 117 are symmetrically positioned about the central protrusion 117 in the axial direction. More specifically, here, a region W1 is defined as a length and the position of the sealing member 116 in the axial direction, as shown in FIGS. 3A and 3B. Each inner protrusion 117 is positioned and has a length in the axial direction the same as those of the regions W1 of the sealing member 116.

As shown in FIG. 4, an agitator 114A is disposed within the toner accommodation chamber 114. The agitator 114A rotates in a clockwise direction in FIG. 4 upon receipt of driving force transmitted from a motor (now shown) provided within the main casing 2. In accordance with the rotation of the agitator 114A, toner within the toner accommodation chamber 114 is agitated and is conveyed to the inner opening 115.

The outer casing 120 includes a circumferential wall section 121 and two side wall sections 122 and 123, as shown in FIGS. 2A and 2B. The circumferential wall section 121 has a circular cylindrical shape. The circumferential wall section 121 has the inner circumferential surface 121A within which the inner casing 110 is accommodated. The circumferential wall section 121 has widthwise ends in the axial direction which are covered with the side wall sections 122 and 123. The side wall sections 122 and 123 support the inner casing 110 such that the inner casing 110 and the outer casing 120 are relatively rotatable to each other.

The circumferential wall section 121 is formed with three outer openings 125 that are aligned in the axial direction. Each outer opening 125 has a substantially rectangular shape in a plan view and is disposed at a position coincident with each inner opening 115 formed on the inner casing 110. More specifically, three outer openings 125 are formed such that, one is positioned at a center of the circumferential wall section 121 with respect to the axial direction and the other two outer openings 125 are symmetrically positioned about the central outer opening 125 in the axial direction.

As shown in FIG. 2A, when the inner opening 115 and the outer opening 125 are in coincident with each other as a result of relative rotation between the inner and outer casings 110, 120, the inner opening 115 and the outer opening 125 are in communication with each other and, therefore, the toner accommodated within the toner accommodation chamber 114 is supplied to the developing cartridge 7 via the inner opening 115 and the outer opening 125. At this time, the toner box 100 is called to be in the "open state." Contrary, as shown in FIG. 2B, when inner casing 110 and the outer casing 120 are relatively rotated to each other from the open state, the inner opening 115 is covered with the circumferential wail section 121 of the outer casing 120, enabling the circumferential wall section 121 to serve as a shutter to close the inner opening 115. The toner box 100 at this time is called to be in the "closed state." In this way, the inner casing 110 and the outer casing 120 are rotatable relative to each other between the open state and the closed state.

As shown in FIG. 4, the outer casing 120 accommodates the inner casing 110 therein such that a prescribed gap is provided therebetween. More specifically, when the toner box 100 is in the open state, the sealing members 116 and the inner protrusions 117 of the inner easing 110 are respectively in contact with the inner circumferential surface 121A of the outer casing 120, thereby enabling the inner casing 110 to be maintained within the outer casing 120 in such a state that the prescribed gap can be formed between the inner circumferential surface 121A and the outer circumferential surface 111A.

The outer casing 120 has three outer protrusions 127 that radially inwardly protrude (i.e., toward the inner casing 110) from the inner circumferential surface 121A of the circumferential wail section 121. Each outer protrusion 127 has a substantially semi-circular columnar shape. The three outer protrusions 127 are arrayed in the axial direction, and are disposed such that, one is positioned at a center of the inner circumferential surface 121A with respect to the axial direction, and the other two outer protrusions 127 are symmetrically positioned about the central outer protrusion 127 in the axial direction. In this way, the outer protrusions 127 are configured to be in coincident with the inner protrusions 117 when the inner casing 110 and the outer casing 120 rotate relative to each other. Further, each outer protrusion 127 has a length in the axial direction substantially identical to the length of the sealing member 116 within the region W1.

To provide the closed state from the open state, as shown in FIG. 4, when the outer casing 120 is made to rotate relative to the inner casing 110 about the axis C in the clockwise direction, by a rotational angle A1, the outer protrusion 127 contacts the inner protrusion 117. In the mean time, the outer casing 120 covers the opening 116C of the sealing member 116 by rotating about the axis C by a rotational angle A2. As apparent from FIG. 4, the rotational angle A1 is greater than the rotational angle A2 in the present embodiment.

As shown in FIGS. 2A and 2B, each side wail section 122 (123) is formed with an operation portion 128 and a pair of engaging protrusions 129. The operation portion 128 is used when a user rotates the inner casing 110 and the outer casing 120 relative to each other between the open state and the closed state. The engaging protrusions 129 are configured to engage a shutter 75 (FIGS. 5A and 5B) of the developing cartridge 7 (to be described next) when the toner box 100 is mounted on the developing cartridge 7.

Figure 5A:
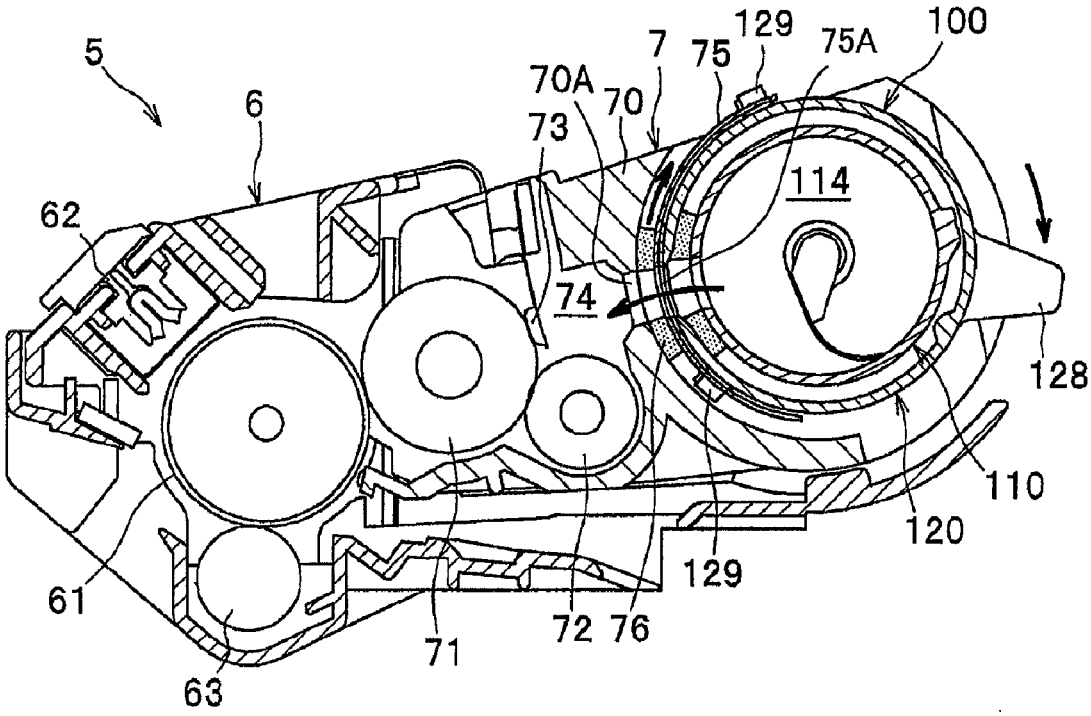
FIG. 5A is a cross-sectional view of the process cartridge according to the first embodiment, in which the toner box is in the open state.
Figure 5B:
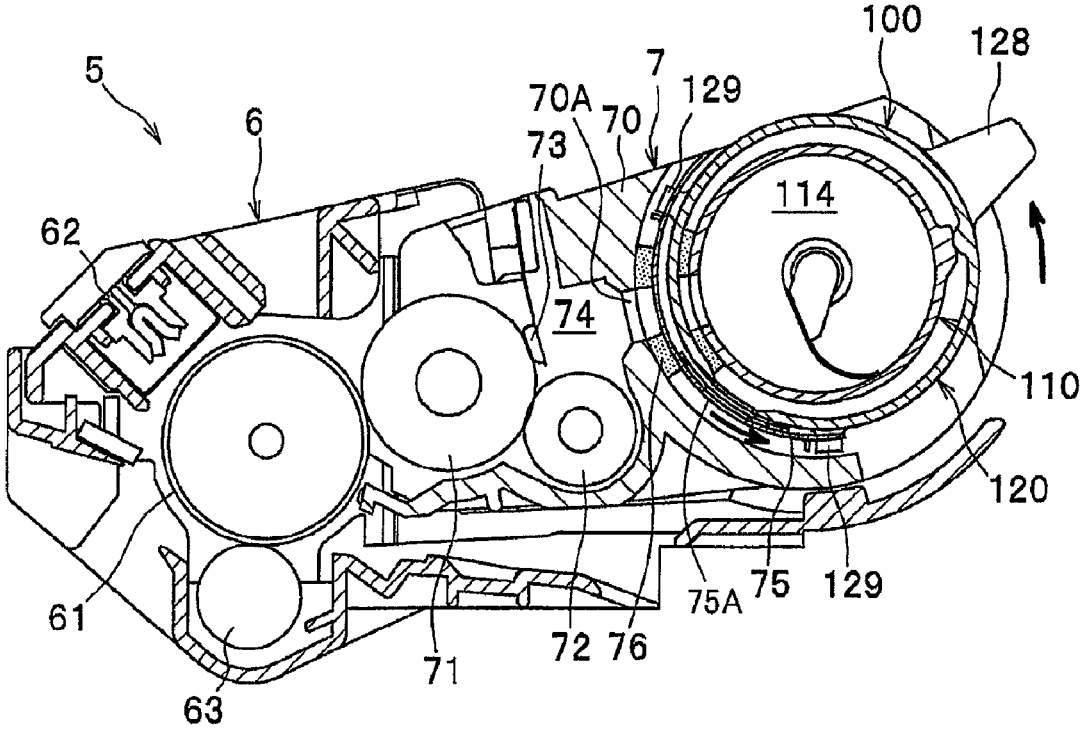
FIG. 5B is a cross-sectional view of the process cartridge according to the first embodiment, in which the toner box is in the closed state.

Referring to FIGS. 5A and 5B, the developing cartridge 7 includes a developing frame 70 and the shutter 75. The developing frame 70 defines therein a developing chamber 74 within which the developing roller 71 and the supply roller 72 are disposed. The developing frame 70 is also formed with a port 70A that introduces toner to the developing chamber 74 from the toner accommodation chamber 114. The shutter 75 has a substantially arcuate shape in cross-section, following a contour of the outer casing 120 of the toner box 100. The shutter 75 has an aperture 75A. The shutter 75 is movably supported to the developing frame 70 such that the shutter 75 can close or open the port 70A. Specifically, the shutter 75 is movable between a position where the aperture 75A is aligned with the port 70A, to open the port 70A so that the developing chamber 74 and the toner accommodation chamber 114 can be in communication with each other (FIG. 5A), and a position where the port 70A is closed so as not to allow the toner to be introduced from the toner accommodation chamber 114 to the developing chamber 74 (FIG. 5B).

The shutter 75 is formed with openings or cutouts adapted to engage the engaging protrusions 129 of the outer casing 120 when the toner box 100 is mounted on the developing cartridge 7. As the user moves the operation portion 128, the outer casing 120 angularly rotates relative to the inner casing 110, and the toner box 100 becomes the open state. In conjunction with the rotation of the outer casing 120, the shutter 75, which is in engagement with the engaging protrusions 129, is made to move to the position shown in FIG. 5A, thereby opening the port 70A for allowing the developing chamber 74 and the toner accommodation chamber 114 to be communicable.

When the toner box 100 is mounted on the developing cartridge 7, the side walls 112 and 113 of the inner casing 110 are in engagement with the developing frame 70 of the developing cartridge 7, restricting the inner casing 110 from rotating relative to the developing frame 70. Hence, in the present embodiment, the outer casing 120 is configured to rotate relative to the inner casing 110 when the user manipulates the operation portion 128. A sealing member 76 is provided between the developing frame 70 and the shutter 75. The sealing member 76 surrounds the port 70A for preventing toner from leaking between the developing frame 70 and the shutter 75.

Next, operations to make the outer casing 120 rotate relative to the inner casing 110 from the open state to the closed state will be described with reference to FIGS. 4 through 6C.

In the open state, the outer protrusion 127 and the inner protrusion 117 are at separated positions from each other with respect to the circumferential direction of the inner easing 110, as shown in FIGS. 4 and 5A.

In order to rotate the outer easing 120 from the open state (FIGS. 4 and 5A) to the closed state (FIG. 5B), the user needs to move the operation portion 128 in a counterclockwise direction in FIG. 5A. Hereinafter, the direction in which the outer casing 120 rotates will be referred to as the "rotational direction."

Figure 6A:
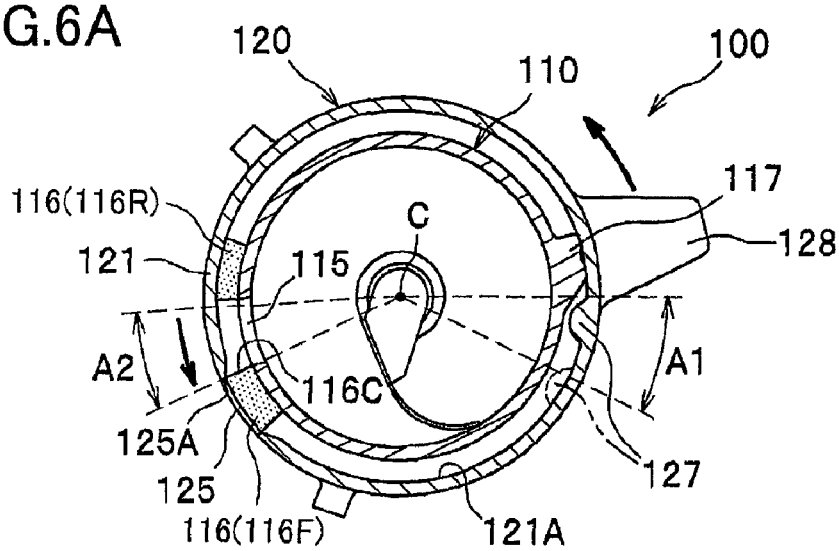
FIG. 6A is a cross-sectional view of the toner box according to the first embodiment, in which the outer casing is angularly rotated by a rotational angle A2 from the open state.

Referring to FIG. 6A, for the sake of explanation, a periphery of the outer opening 125 located rearward in the rotational direction will be referred to as the rear periphery 125A. Also, referring to FIG. 4 and 6A, the sealing member 116 is assumed to have a front portion 116F and a rear portion 116R, the front portion 116F being located forward of the rear portion 116R in the rotational direction with the opening 116C interposed therebetween.

In FIG. 6A, while the outer casing 120 is made to rotate by the rotational angle A2, the rear periphery 125A passes the inner opening 115 and contacts the front portion 116F of the sealing member 116. In this way, the outer casing 120 (the circumferential wall section 121) covers the opening 116C (the inner opening 115). In the present embodiment, the rotational angle A1 is made greater than the rotational angle A2. Therefore, at the time when the outer casing 120 covers the opening 116C, the inner protrusion 117 and the outer protrusion 127 have not yet been in contact with each other.

Figure 6B:
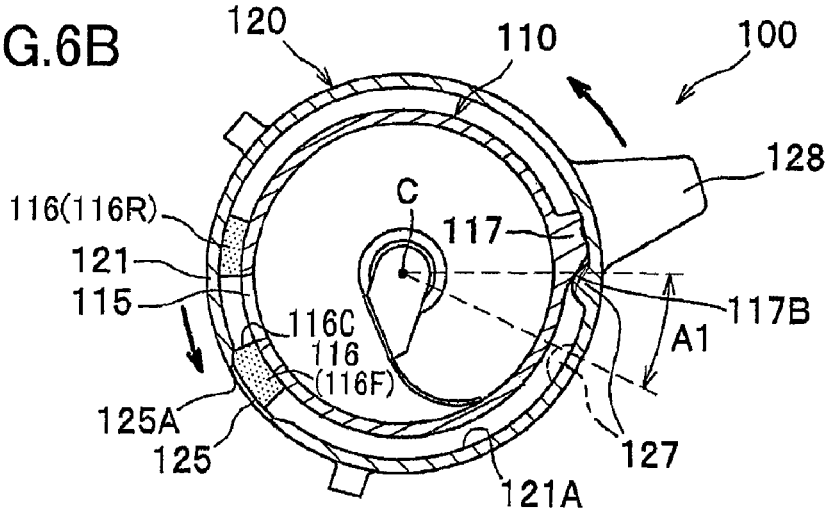
FIG. 6B is a cross-sectional view of the toner box according to the first embodiment, in which the outer casing is angularly rotated, by a rotational angle A1 from the open state.

Subsequently, when the outer casing 120 is further rotated by the rotational angle A1, the inner protrusion 117 (the sloped surface 117B) and the outer protrusion 127 are brought into contact with each other, as shown in FIG. 6B. At this time, the rear periphery 125A of the outer opening 125 has also moved by the rotational angle A1, and therefore the rear periphery 125A (the circumferential wail section 121) and the sealing member 116 partially overlap with each other.

From the state shown in FIG. 6B, when the outer casing 120 is made to rotate further forward in the rotational direction, the outer protrusion 127 climbs the sloped surface 117B, making the outer protrusion 127 and the inner protrusion 117 slidingly contact with each other. When the outer protrusion 127 finally climbs up to reach the top surface of the inner protrusion 117 and engages the recess 117A, the outer casing 120 is in the closed state, as shown in FIG. 6C.

Figure 6C:
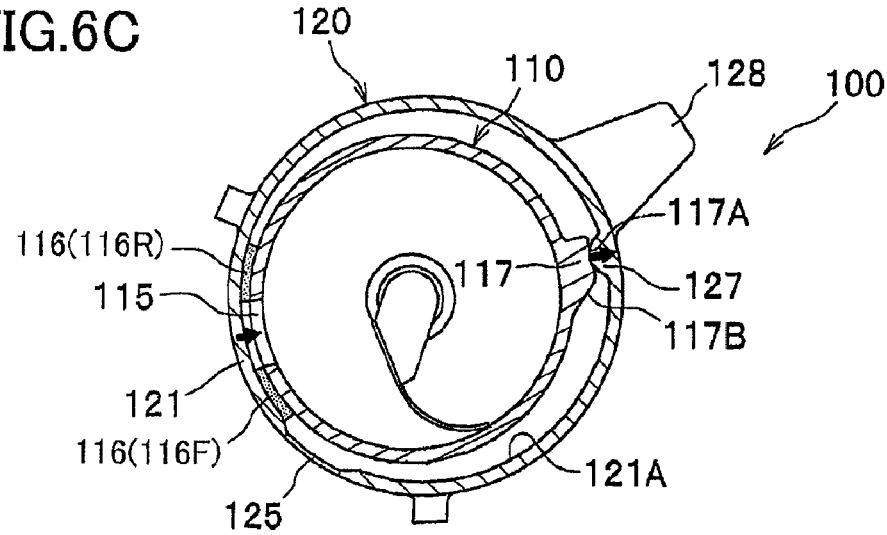
FIG. 6C is a cross-sectional view of the toner box according to the first embodiment, in which the outer casing is angularly rotated to the closed state from the open state.

While the outer protrusion 127 climbs up the sloped surface 117B and slidingly contacts the inner protrusion 117, the outer casing 120 is gradually urged to move closer to the inner opening 115 as indicated by an arrow in FIG. 6C. When the outer protrusion 127 is in engagement with the recess 117A, the outer casing 120 and the inner opening 115 are to have a distance closest to each other (the gap between the inner casing 110 and the outer casing 120 becomes smallest in the vicinity of the inner opening 115).

In the above-described process, the elastic sealing member 116 is gradually pressed by the outer casing 120, and is eventually, in the closed state, squashed between the outer casing 120 and the inner casing 110 around the inner opening 115. In this way, the sliding contact resistance between the inner casing 110 and the outer casing 120 becomes greater, making relative rotation between the inner casing 110 and the outer casing 120 difficult.

As shown in FIGS. 6A and 6B, until the outer protrusion 127 contacts the inner protrusion 117, the inner protrusion 117 (the top surface of the inner protrusion 117) slidingly contacts the inner circumferential surface 121A of the outer casing 120 in accordance with the rotation of the outer casing 120. With this configuration, the gap between the inner casing 110 and the outer casing 120 can be maintained so that the sliding contact resistance at the time of rotation can be suppressed low, thereby facilitating the user's operation to rotate the outer casing 120.

As above-described, the outer casing 120 can accommodate the inner casing 110 therewithin such that the inner casing 110 and the outer casing 120 can rotate relative to each other while the gap is kept therebetween. Therefore, the user can rotate the outer casing 120 easily relative to the inner casing 110 since there is small sliding contact resistance generated at the time of rotating the outer casing 120.

Further, in the closed state, as the outer protrusion 127 climbs up the sloped surface 117B and in contact with the top surface of the inner protrusion 117, the outer casing 120 is brought closer to the inner opening 115, thereby pressing and squashing the sealing member 116 between the inner casing 110 and the outer casing 120. Hence, the inner casing 110 can be made resistant to the relative rotation against the outer casing 120. This configuration can prevent toner leakage from the toner box 100 during transportation thereof.

Further, the rotational angle A1 by which the outer casing 120 rotates until the outer protrusion 127 contacts the inner protrusion 117 is greater than the rotational angle A2 by which the outer casing 120 rotates until the outer casing 120 covers the opening 116C of the sealing member 116 in the present embodiment. Therefore, the rear periphery 125A of the outer opening 125 can be reliably overlapped with the sealing member 116 before the outer easing 120 is in the closed state where the inner opening 115 is closest to the outer casing 120. In this way, the inner opening 115 is covered with the outer casing 120 with the shortest gap therebetween.

Suppose that the rotational angle A1 is smaller than the rotational angle A2. In this case, when the outer casing 120 is made to rotate by the rotational angle A1, the outer protrusion 127 contacts the inner protrusion 117. When the outer casing 120 rotates further in the rotational direction, the outer protrusion 127 climbs up the sloped surface 117B and slidingly contacts the top surface of the inner protrusion 117, while the outer casing 120 displaces closer to the inner opening 115. When the outer casing 120 is further made to rotate by the rotational angle A2, the rear periphery 125A of the outer opening 125 contacts a tip end of the opening 116C of the sealing member 116.

If the outer casing 120 is further made to rotate from this state, the rear periphery 125A pushes the tip end of the opening 116C of the sealing member 116 in the rotational direction and may peel the sealing member 116 off from the outer circumferential surface 111A of the inner casing 110. In the present embodiment, the rear periphery 125A of the outer opening 125 and the sealing member 116 can be overlapped with each other before the outer casing 120 is urged to be moved toward the inner opening 115. Hence, peel-off of the sealing member 116 from the inner casing 110 can be suppressed.

Further, in the present embodiment, the inner protrusion 117 is provided at a side diametrically opposite to the sealing member 116 with respect to the axis C. With this configuration, the pressing force acting in a direction to squash the sealing member 116 as a result of the contact between the inner protrusion 117 and the outer protrusion 127 can be reliably transmitted to the sealing member 116.

Further, the inner protrusions 117 and the outer protrusions 127 are provided symmetrically with respect to the axial center of the casings 110, 120, respectively. Therefore, the pressing force acting on the sealing member 116 can be generated uniformly in the axial direction.

Further, each inner protrusion 117 and each outer protrusion 127 are respectively provided within the region W1 within which each sealing member 116 is provided in the axial direction. Therefore, the pressing force that acts to squash the sealing member 116 can be transmitted to the sealing member 116 more reliably.

As described, the present embodiment enables the pressing force to be reliably transmitted to the sealing member 116 as well as to be uniform in the axial direction. Therefore, in the closed state, there is generated little gap between the squashed sealing member 116 and the outer casing 120 (the inner circumferential surface 121A), surely preventing the toner from leaking outside.

Although, in the present embodiment, the three inner protrusions 117 and the three outer protrusions 127 are respectively aligned in the axial direction such that one is at the center and the other two are symmetrically positioned about the central one, the present embodiment is not limited to this configuration.

For example, two inner protrusions 117 and two outer protrusions 127 may be respectively provided on both sides in the axial direction. Alternatively, not less than four inner protrusions 117 and not less than four outer protrusions 127 may be aligned in the axial direction.

Further, instead of the present configuration in which the inner protrusion 117 and the outer protrusion 127 are disposed within the region W1 with a length substantially identical to that of the sealing member 116 in the axial direction, the inner protrusion 117 and the outer protrusion 127 may have a length shorter than that of the sealing member 116 in the axial direction within the region W1.

Figure 7A:
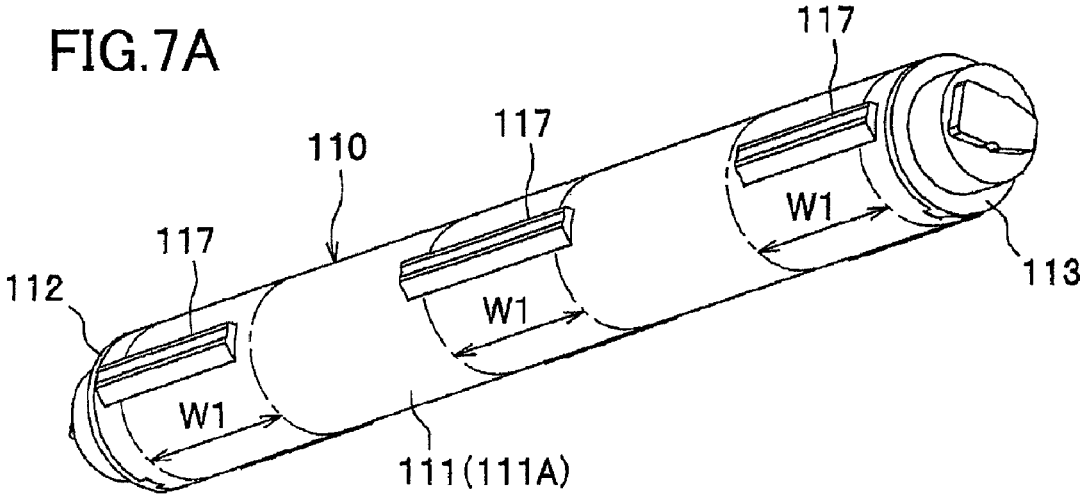
FIG. 7A is a perspective view of an inner casing according to a first modification to the first embodiment, in which each part of each inner protrusion spans within a region W1.

Alternatively, as shown in FIG. 7A, at least a portion of the inner protrusion 117 and a portion of the outer protrusion 127 (not shown) may be positioned within the region W1, respectively. In this case, a portion of the inner protrusion 117 may span the entire region W1 as in the central inner protrusion 117, or a portion of the inner protrusion 117 may partially occupy the region W1 as in the inner protrusions 117 located on left and right sides.

Figure 7B:
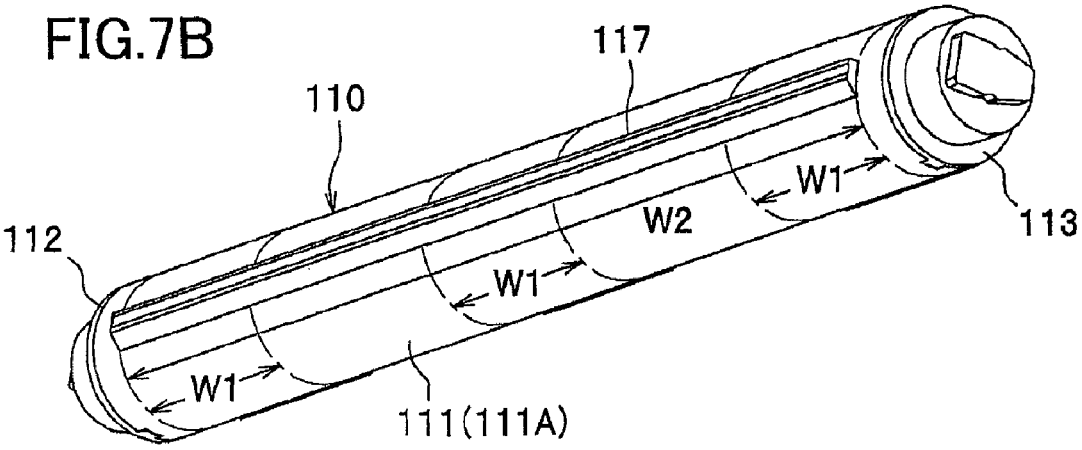
FIG. 7B is a perspective view of an inner casing according to a second modification to the first embodiment, in which a single inner protrusion spans across a region W2.

Still alternatively, as shown in FIG. 7B, a single inner protrusion 117 and a single outer protrusion 127 (not shown) may be provided respectively to have a length in the axial direction that spans a region W2, the region W2 being a region between the two outermost sealing members 116 (more specifically, between outer ends of the two outermost sealing members 116). With this arrangement, the pressing force acting in the direction to squash the sealing members 116 can be uniform. Therefore, a gap between the squashed sealing members 116 and the outer casing 120 can be almost eliminated, ensuring that toner leakage can be reliably prevented in the closed state. Also, respective lengths of the inner protrusion 117 and the outer protrusion 127 (not shown) in the axial direction may be greater than the region W2.

Figure 7C:
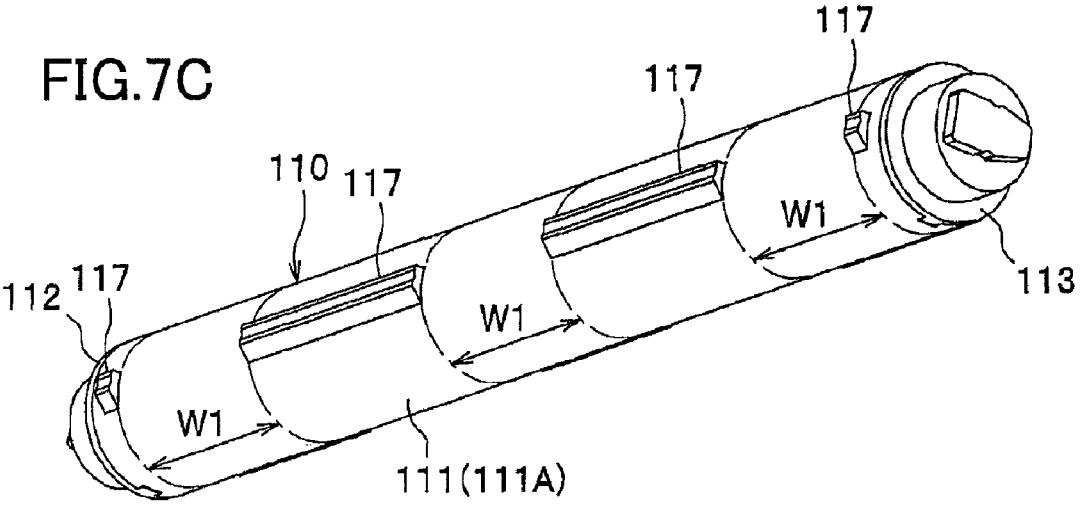
FIG. 7C is a perspective view of an inner casing according to a third modification to the first embodiment, in which each inner protrusion is located outside of the region W1.

Further alternatively, as shown in FIG. 7C, the inner protrusion 117 and the outer protrusion 127 (not shown) may be provided outside of the region W1. Note that the portions of the inner casing 110 on which the inner openings 115 are formed and the portions of the outer casing 120 on which the outer openings 125 are formed respectively have a strength weaker relative to other portions of the inner casing 110 and the outer casing 120. Hence, arranging the inner protrusions 117 and the outer protrusions 127 outside of the region W1 can ease the pressing force acting on the sealing members 116 provided around the inner openings 115 and the outer openings 125. With this arrangement, deformation of the inner casing 110 and the outer casing 120 can be suppressed, thereby restraining toner from leaking between the inner casing 110 and the outer casing 120. The lengths of the inner protrusion 117 and the outer protrusion 127 may be changed appropriately.

Next, a toner box 100 according to a second embodiment of the present invention will be described with reference to FIGS. 8A through 9B. Note that, hereinafter, like parts and components are designated by the same reference numerals as those shown in FIGS. 1 through 7C to avoid duplicating description.

Figure 9A:
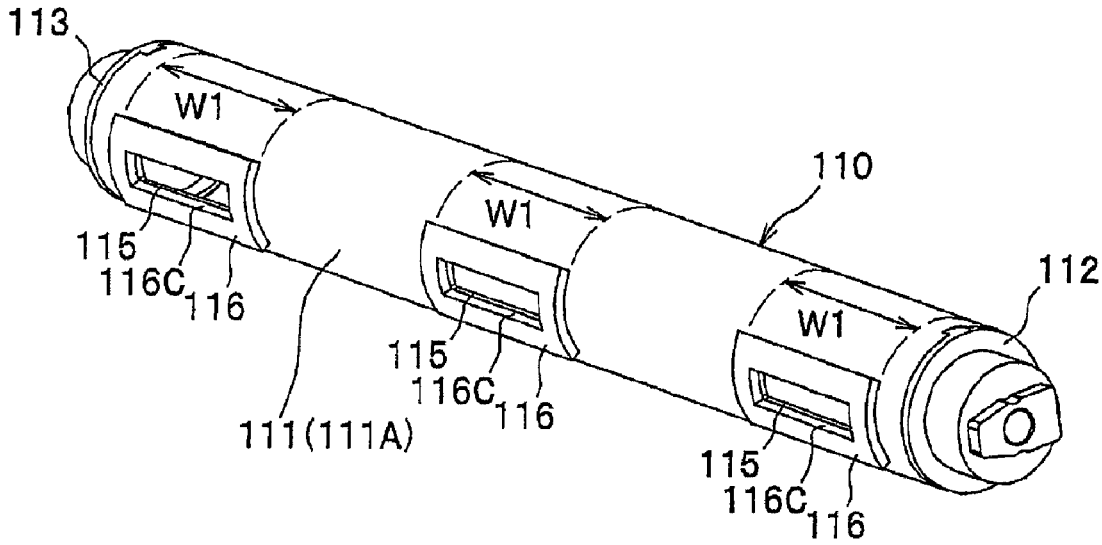
FIG. 9A is a perspective view of an inner casing constituting the toner box according to the second embodiment, as viewed from a direction to observe inner openings.
Figure 9B:
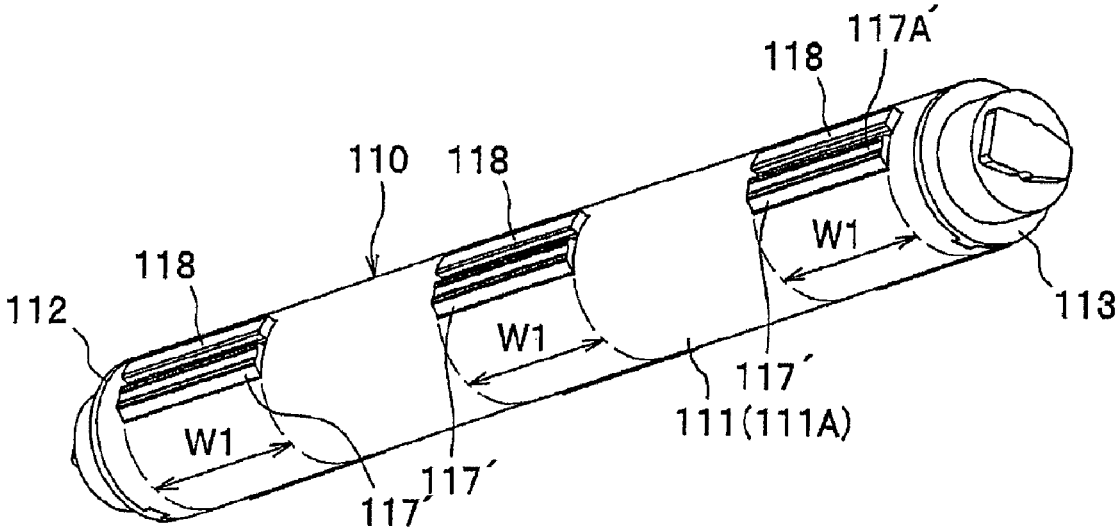
FIG. 9B is a perspective view of the inner casing according to the second embodiment as viewed from a different direction to observe inner protrusions.

As shown in FIGS. 9A and 9B, the inner casing 110 according to the second embodiment includes the outer circumferential surface 111A, three sealing members 116, three inner protrusions 117', and three restricting protrusions 118. The three restricting protrusions 118 are provided on the outer circumferential surface 111A such that, all the three restricting protrusions 118 are aligned in the axial direction and each is paired with one of the inner protrusions 117', as shown in FIG. 9B.

Figure 8A:
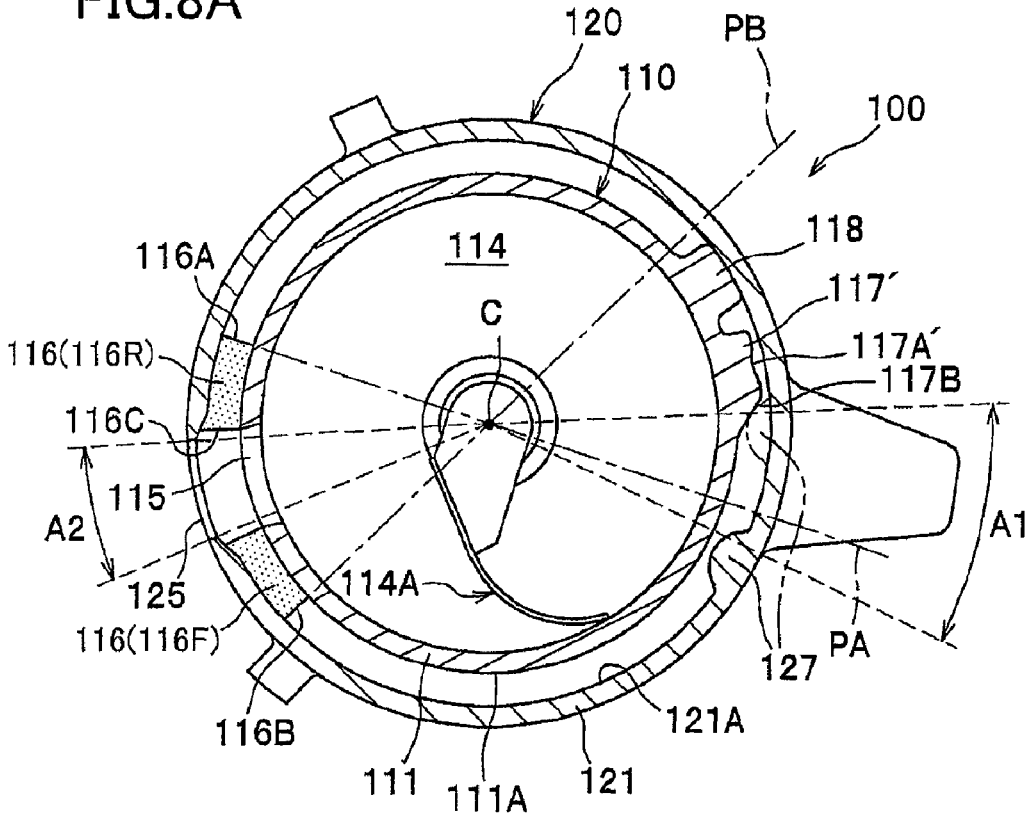
FIG. 8A is a cross-sectional view of a toner box according to a second embodiment, in which the toner box is in the open state.
Figure 8B:
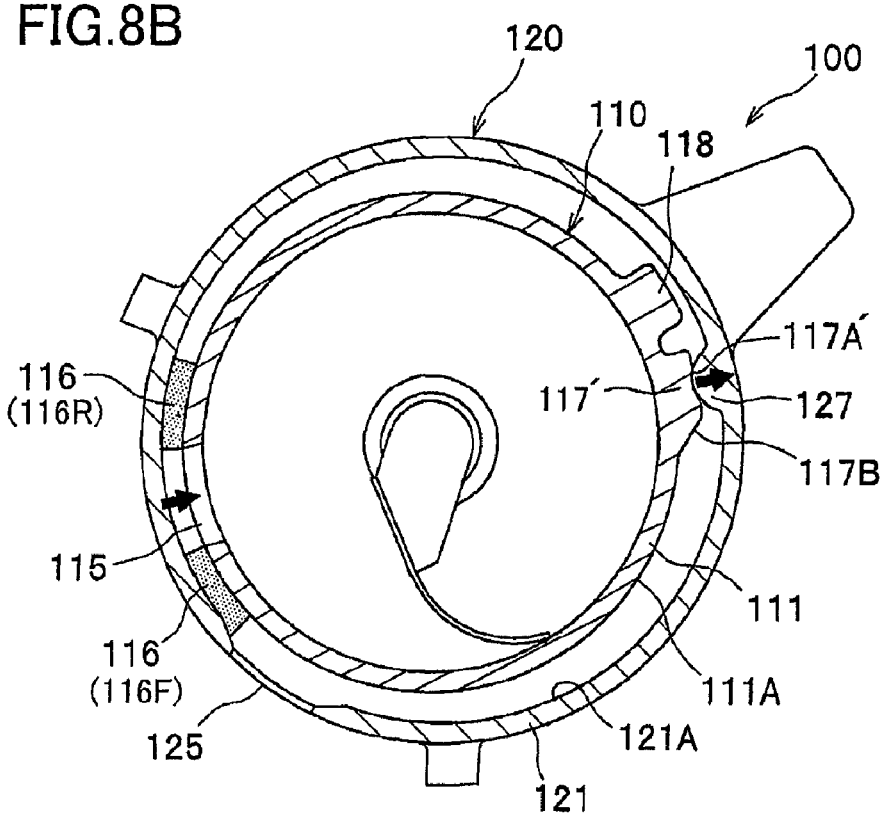
FIG. 8B is a cross-sectional view of the toner box according to the second embodiment, in which the toner box is in the closed state.

As shown in FIGS. 8A and 8B, each restricting protrusion 118 protrudes from the outer circumferential surface 111A toward the outer casing 120 at a position adjacent to and above the corresponding inner protrusion 117' in FIG. 8A. The restricting protrusion 118 has a substantially rectangular columnar shape and is provided with a top surface. The restricting protrusion 118 is formed to have such a height that the top surface is in continuous sliding contact with the inner circumferential surface 121A of the outer casing 120 when the inner casing 110 and the outer casing 120 rotate relative to each other from the open state to the closed state.

The restricting protrusion 118 is disposed at a side opposite to the sealing member 116 with respect to the axis C. More specifically, the restricting protrusion 118 is provided on the outer circumferential surface 111A in association with the corresponding inner protrusion 117' at a position opposite to the sealing member 116 with respect to the axis C and in a region interposed between the planes PA and PB.

Further, as shown in FIGS. 9A and 9B, three restricting protrusions 118 are provided such that, one is positioned at a center of the circumferential wall section 111 with respect to the axial direction, and the other two are symmetrically positioned about the centrally-positioned restricting protrusion 118 in the axial direction. Each restricting protrusion 118 has a length in the axial direction the same as those of the sealing member 116 and the inner protrusion 117' within the region W1.

The inner protrusion 117' of the second embodiment is different from the inner protrusion 117 of the first embodiment only in that the height of inner protrusion 117' according to the second embodiment is shorter and therefore the top surface of the inner protrusion 117' does not slidingly contact the inner circumferential surface 121A of the outer casing 120. The outer casing 120 according to the second embodiment has a configuration identical to that of the first embodiment.

In the toner box 100 of the second embodiment with the above-described configuration, while the outer casing 120 is made to rotate relative to the inner casing 110 from the open state until the inner protrusion 117' and the outer protrusion 127 contact with each other, the restricting protrusion 118 serves to maintain the gap between the inner casing 110 and the outer casing 120 by slidingly contacting the inner circumferential surface 121A of the outer casing 120. At this time, the user can rotate the outer casing 120 easily since there is generated small sliding contact resistance.

In the second embodiment, the restricting protrusion 118 is provided for an exclusive purpose of maintaining the gap between the inner casing 110 and the outer casing 120, which means that the height of the inner protrusion 117' can be determined at a greater discretion. Hence, the pressing force acting in the direction to squash the sealing member 116 can also be adjusted appropriately depending on materials of the sealing member 116, leading to prevention of toner leakage.

Further, the restricting protrusion 118 is disposed at a side opposite to the sealing member 116 with respect to the axis C. Hence, in the open state, both of the restricting protrusion 118 and the sealing member 116 are in contact with the inner circumferential surface 121A of the outer casing 120, and therefore, backlash or rattling of the outer casing 120 relative to the outer casing 110 can be suppressed effectively.

In the present embodiment, the restricting protrusion 118 is disposed in association with the inner protrusion 117', but the present invention does not limited to this configuration. For example, only one long restricting protrusion 118 may be provided in the axial direction vis-a-vis the three inner protrusions 117' that are aligned in the axial direction. Further, the second embodiment may be applied with modifications the same as those applied to the first embodiment (shown in FIGS. 7A through 7C).

While the invention has been described in detail with reference to the embodiments thereof, it would be apparent to those skilled in the art that various changes and modifications may be made therein without departing from the spirit of the invention.

For example, the inner protrusion 117 (117') and the outer protrusion 127 may extend to the axially outermost sides of the circumferential wall section 111 and the circumferential wall section 121 in the axial direction respectively.

The three inner protrusions 117 (117') and three outer protrusions 127 are arranged in the axial direction in association with each other in the above embodiments. However, instead, another configuration may also be employed in which three inner protrusions 117 (117') may be aligned in the axial direction, whilst only one long outer protrusion 127 may be arranged in the axial direction.

In the above-described configuration, referring to FIG. 4, the inner casing 110 and the outer casing 120 are in contact with each other at three points in the open state, when seen in the radial direction, by the inner protrusion 117 (or the restricting protrusion 118) and the sealing member 116 surrounding the inner opening 115 (more specifically, the front portion 116F and the rear portion 116R of the sealing member 116). However, the inner casing 110 and the outer casing 120 may be so configured as to contact with each other at more than four points by providing increased number of restricting protrusions 118. Providing protrusions appropriately for maintaining the gap between the inner casing 110 and the outer casing 120 can facilitate rotating operations performed by the user.

Further, instead of aligning the three inner openings 115 and the three outer openings 125 in the axial direction such that one at the center and the other two symmetrically about the central one, other arrangements of openings may be possible.

For example, an elongated single opening extending in the axial direction may be formed, or two openings may be formed, or not less than four openings may be formed. Further, shapes and sizes (length in the axial direction) of the openings may also be changed accordingly.

As to the sealing members 116, all the three inner openings 115 are surrounded by the three sealing members 116 in the above embodiments. However, one sealing member that encompasses all the inner openings 115 may be employed instead. In the latter case, the sealing member may be formed with a plurality of openings that corresponds to the number of the formed inner openings 115.

Further, the present invention has been described with reference to the laser printer 1 as an example of image forming devices in which the toner box 100 of the present invention is mounted. However, the present invention may also be applicable to other types of image forming devices such as an LED printer, a copier and a multifunction device.

What is claimed is:

1. A developer cartridge comprising:

an inner casing configured to accommodate toner therein, the inner casing having a circular cylindrical shape whose axis extends in an axial direction, the inner casing being formed with an inner opening, the inner casing having an outer peripheral surface defining a circumferential direction;

an outer casing configured to accommodate the inner casing therein, the outer casing having a circular cylindrical shape and being formed with an outer opening, the outer casing and the inner casing being capable of rotating relative to each other between a first position where the inner opening and the outer opening are in communication with each other and a second position where the outer casing covers the inner opening;

a sealing member provided on the outer peripheral surface of the inner casing and surrounding the inner opening, the sealing member being elastically deformable;

an inner protrusion protruding from the outer peripheral surface of the inner casing toward the outer casing;

an outer protrusion protruding from the outer casing toward the inner casing, and serving to maintain a prescribed gap between the inner casing and the outer casing, the outer protrusion being in separation from the inner protrusion in the circumferential direction at the first position, and the outer protrusion being in riding contact with the inner protrusion at the second position to displace the outer casing toward the inner opening and to elastically squash the sealing member between the inner casing and the outer casing in the second position.

2. The developer cartridge according to claim 1, wherein the outer protrusion, the inner protrusion and the inner opening are relatively angularly positioned such that a first angle is greater than a second angle, in which the first angle is an angle by which the outer protrusion contacts the inner protrusion upon relative rotation between the inner casing and the outer casing starting from the first position; and the second angle is an angle by which the outer casing completely covers the inner opening upon relative rotation between the inner casing and the outer casing starting from the first position.

3. The developer cartridge according to claim 2, wherein the inner protrusion is in sliding contact with the outer casing upon relative rotation between the inner casing and the outer casing for changing the first position to the second position.

4. The developer cartridge according to claim 2, wherein the inner casing further comprises a restricting protrusion that protrudes from the outer peripheral surface toward the outer casing, the restricting protrusion being in constant sliding contact with the outer casing during relative rotation between the inner casing and the outer casing during a period starting from the first position and ending at the second position.

5. The developer cartridge according to claim 4, wherein the restricting protrusion is disposed at a side opposite to the sealing member with respect to the axis of the inner casing.

6. The developer cartridge according to claim 4, wherein the restricting protrusion is positioned adjacent to the inner protrusion and at a position to avoid abutment with the outer protrusion as a result of the relative rotation by the first angle.

7. The developer cartridge according to claim 1, wherein the inner protrusion is disposed at a side opposite to the sealing member with respect to the axis of the inner casing.

8. The developer cartridge according to claim 7, wherein the sealing member is disposed within a first region with respect to the axial direction, at least a portion of the inner protrusion being located within the first region with respect to the axial direction, and, at least a portion of the outer protrusion being located within the first region with respect to the axial direction.

9. The developer cartridge according to claim 7, wherein the sealing member has two outermost ends in the axial direction, a second region spanning between the two outermost ends being defined; and wherein the inner protrusion comprises a single inner protrusion having a length in the axial direction that spans at least over the second region.

10. The developer cartridge according to claim 7, wherein the sealing member is disposed within a first region with respect to the axial direction, the inner protrusion and the outer protrusion being respectively disposed at positions outside of the first region.

11. The developer cartridge according to claim 1, wherein the inner protrusion comprises at least two inner protruding portions extending and arrayed in the axial direction; and wherein the outer protrusion comprises at least two outer protruding portions extending and arrayed in the axial direction.

12. The developer cartridge according to claim 11, wherein the axis of the inner casing has a longitudinal center;

wherein the at least two inner protruding portions are positioned symmetrically with each other with respect to the longitudinal center; and wherein the at least two outer protruding portions are positioned symmetrically with each other with respect to the longitudinal center.

* * * * *